US005421359A

United States Patent [19]

Meister et al.

[11] Patent Number: 5,421,359

[45] Date of Patent: Jun. 6, 1995

[54] ENGINE VALVE SEATING VELOCITY HYDRAULIC SNUBBER

[75] Inventors: Steven F. Meister, Chillicothe; Scott F. Shafer, Morton, both of Ill.

[73] Assignee: Caterpillar Inc., Peoria, Ill.

[21] Appl. No.: 107,774

[22] PCT Filed Jan. 13, 1992

[86] PCT No.: PCT/US92/00202

§371 Date: Jan. 13, 1992

§102(e) Date: Jan. 13, 1992

[87] PCT Pub. No.: WO93/14339

PCT Pub. Date: Jul. 22, 1993

[51] Int. Cl.[6] ..... F01L 1/02; F01L 9/02; F16K 31/122

[52] U.S. Cl. ..... 137/12; 123/90.12; 251/48; 251/57

[58] Field of Search ..... 137/12; 123/90.12, 90.13, 123/90.14, 90.15; 251/48, 57

[56] References Cited

U.S. PATENT DOCUMENTS

| | | | |
|---|---|---|---|
| 763,833 | 6/1904 | Albree | 251/57 |
| 1,062,580 | 5/1913 | Fils | 251/57 |
| 1,427,111 | 8/1922 | Knudsen | 123/90.49 |
| 1,810,465 | 6/1931 | DaCosta | 123/90.12 |
| 1,965,517 | 7/1934 | Vitalini | 123/90.12 |
| 2,602,434 | 7/1952 | Barnaby | 123/90.12 |
| 3,119,592 | 1/1964 | Fraschetti | 251/57 |
| 3,182,971 | 5/1965 | Wakeman et al. | 251/57 |
| 3,257,999 | 6/1966 | Fiedler | 123/90.12 |
| 3,368,787 | 2/1968 | Sachnik et al. | 251/57 |
| 3,648,967 | 3/1972 | O'Neill et al. | 251/57 |
| 3,672,628 | 6/1972 | Aanstad | 251/47 |
| 3,844,528 | 10/1974 | Massie | 251/30 |
| 3,938,483 | 2/1976 | Firey | 123/90.12 |
| 4,278,233 | 7/1981 | Zürner et al. | 251/57 |
| 4,312,494 | 1/1982 | Aoyama | 251/48 |
| 4,552,528 | 11/1985 | Grotloh | 251/30.01 |
| 4,694,787 | 9/1987 | Rhoads | 123/90.13 |
| 4,794,890 | 1/1989 | Richeson, Jr. | 123/90.11 |
| 4,796,573 | 1/1989 | Wakeman et al. | 123/90.16 |
| 4,799,462 | 1/1989 | Tittizer et al. | 123/90.12 |
| 4,838,403 | 6/1989 | Layer | 192/141 |
| 4,860,571 | 8/1989 | Smedberg et al. | 72/453.13 |
| 4,889,085 | 12/1989 | Yagi et al. | 123/90.12 |
| 4,930,464 | 6/1990 | Letsche | 123/90.12 |
| 4,936,226 | 6/1990 | Wiebe | 105/198.3 |
| 4,948,049 | 8/1990 | Brisbon et al. | 239/91 |
| 4,964,462 | 10/1990 | Smith | 166/255 |
| 5,012,785 | 5/1991 | Long et al. | 123/467 |
| 5,113,812 | 5/1992 | Rembold et al. | 123/90.12 |
| 5,158,048 | 10/1992 | Robnett et al. | 123/90.16 |
| 5,193,495 | 3/1993 | Wood, III | 123/90.12 |
| 5,216,988 | 6/1993 | Taxon | 123/90.12 |
| 5,221,072 | 6/1993 | Erickson et al. | 251/30.05 |
| 5,275,136 | 1/1994 | Schechter et al. | 123/90.12 |

FOREIGN PATENT DOCUMENTS

| | | |
|---|---|---|
| 0027949 | 5/1981 | European Pat. Off. . |
| 2252023 | 6/1975 | France . |
| 1250677 | 6/1967 | Germany . |
| 1962916 | 6/1971 | Germany . |
| 2006844 | 8/1971 | Germany . |
| 2057667 | 6/1972 | Germany . |
| 59-229011 | 12/1984 | Japan . |
| 59-229012 | 12/1984 | Japan . |
| 60-085208 | 5/1985 | Japan . |
| 60-252111 | 12/1985 | Japan . |
| 60-259713 | 12/1985 | Japan . |
| 62-041907 | 2/1987 | Japan . |
| 87/07677 | 12/1987 | WIPO . |

*Primary Examiner*—George L. Walton
*Attorney, Agent, or Firm*—Dennis C. Skarvan

[57] ABSTRACT

Adjacent an axially displaceable engine poppet valve (12) is a fluid pathway (36). Within the fluid pathway (36) is a snubbing valve (14) including a snubber (48) movable between first and second locations within the pathway (36) and a snubbing passage (54). When the poppet valve (12) is open, the snubber (48) is at its first location and there is fluid in the fluid pathway (36) between the snubber (48) and poppet valve (12). During a first portion of displacement of the poppet valve (12) as it closes, the snubber (48) is displaced to its second location. During the second portion of displacement of the poppet valve (12) as it closes, fluid in the fluid pathway (36) is snubbed through the snubbing passage (54), thereby increasing the pressure in the fluid in the pathway (36), thereby providing a resistive force against movement of the poppet valve (12), thereby slowing the poppet valve (12) to an acceptable impact seating velocity.

18 Claims, 1 Drawing Sheet

ENGINE VALVE SEATING VELOCITY HYDRAULIC SNUBBER

TECHNICAL FIELD

A snubber for decelerating a moving member, and more particularly, a snubber for decelerating an engine poppet valve during valve closing to an acceptable impact velocity before the valve contacts the valve seat.

BACKGROUND ART

Engine combustion chamber valves are almost universally of a poppet type. A number of means exist for opening such valves including a cam on a rotating cam shaft, hydraulic pressure, electromagnets, and others.

Engine valves are typically spring loaded toward a valve-closed position and opened against the spring bias. Because the valve should open and close very quickly, the spring is typically very stiff and is loaded to a high force under the relatively high force needed to open the valve quickly against the high internal pressures of the combustion chamber. Therefore, when the valve closes, it impacts the valve seat at velocities that can create forces which eventually erode the valve or the valve seat or even fracture or break the valve.

Therefore, it is an object of the present invention to provide a means whereby the valve will be slowed or snubbed as it nears the valve seat so that the valve seats at an acceptable velocity.

It is an additional object of the present invention to provide a hydraulic snubbing valve for slowing the engine poppet valve, wherein the snubbing valve restricts fluid flow exiting a hydraulic fluid path between the engine valve and the snubbing valve as the engine valve closes, thereby slowing the engine valve to an acceptable impact velocity.

DISCLOSURE OF THE INVENTION

In one aspect of the present invention, an apparatus for controllably altering the speed of an engine poppet valve during movement of the poppet valve between first (open) and second (closed) locations is disclosed.

The apparatus includes a valve body having a fluid pathway formed therein. The poppet valve has a first end positioned adjacent a first end of the fluid pathway. The pathway includes a snubber cavity having first and second stops. Positioned within said snubber cavity is a snubber having first and second ends. Extending between the first and second ends of the snubber is a snubbing passage. The snubber is movable between a first location whereat the snubber is against the first stop of the snubber cavity and a second location whereat the snubber is against the second stop of the snubber cavity.

In another aspect of the present invention, a method for controllably altering the speed of an engine poppet valve during movement of the poppet valve between its first and second locations is disclosed. The method includes: the poppet valve exerting a force on fluid in the fluid pathway as the poppet valve is moved in a direction from its open to its closed locations; the force being transmitted through the fluid to the first end of the snubber; the snubber being moved from its first location to its second location by the force; the snubber being stopped at its second location by the first stop of the snubber cavity; fluid being controllably passed through the snubbing passage; the pressure in the fluid being increased in response to controlling the fluid passing through the snubbing passage as the poppet valve continues moving; and the speed of the poppet valve being controllably altered in response to the increasing fluid pressure during further movement of the poppet valve.

BEST MODE FOR CARRYING OUT THE INVENTION

Figure 1:
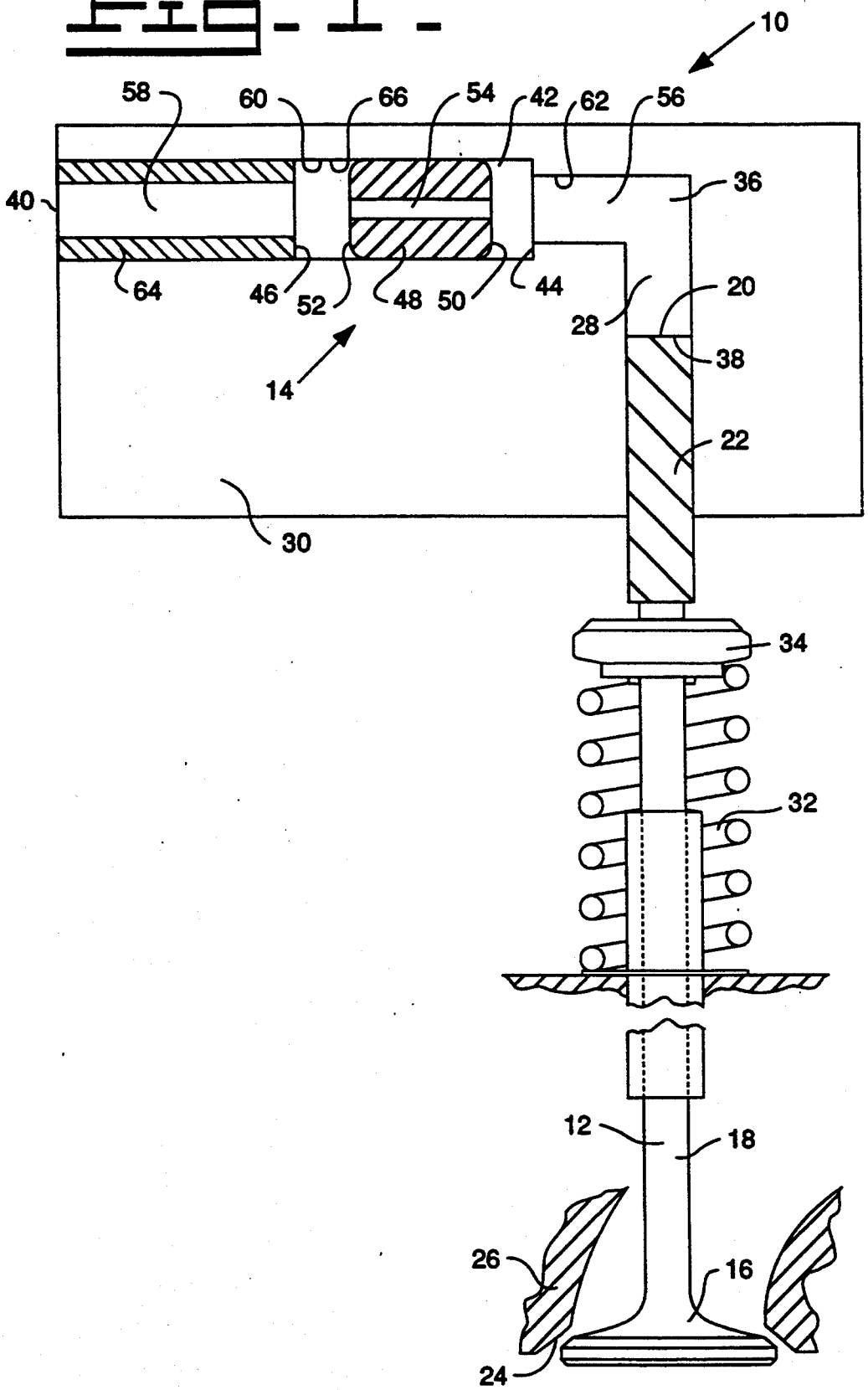
FIG. 1 is an elevation, cross-sectional depiction of an engine poppet valve, fluid pathway, and snubbing valve of the present invention.

Referring now to FIG. 1, a preferred embodiment of an apparatus 10 for controllably altering the speed of a moving member 12, in this case an engine poppet valve, by use of a snubbing valve 14, is shown. The poppet valve 12 includes a head 16 connected to a stem 18 and a first end 20. The stem 18 includes a plunger 22. The poppet valve 12 is movable in a longitudinal direction; down to open, which for purposes of this description is its first location, and up to close, which for purposes of this description is its second position, whereat the head 16 seats against a seat 24 in the bottom of the cylinder head 26. The plunger 22 rides in a bore 28 in a valve body 30. The poppet valve 12 is biased to the closed, second location, by a preloaded return spring 32 which is around the valve stem 18 and fixed between the top 33 of the cylinder head 26 and a collar 34 on the valve stem 18.

Formed within the valve body 30 is a fluid pathway 36 having a first end 38 adjacent the first end 20 of the engine valve 12 and a second end 40. Formed within the fluid pathway 36 is a snubber cavity 42 having first and second ends/hard stops 44,46. The snubbing valve 14 is positioned within the snubber cavity 42 and includes a snubber 48 having first and second ends 50,52 and a snubbing passage 54 extending between the first and second ends 50,52. In the preferred embodiment, the snubbing passage 54 extends axially through the snubber 48.

The snubber 48 is movable between a first location, at which the first end 50 of the snubber is against the first hard stop 44 of the snubber cavity 42 and a second location at which the second end 52 of the snubber 48 is against the second hard stop 46 of the snubber cavity 42. The snubber 48 divides the pathway 36 into two sections, the first section 56 being that portion of the pathway 36 between the first end 50 of the snubber 48 and the first end 20 of the engine valve 12, regardless of the location the snubber 48 and poppet valve 12 might be at any given time, and a second section 58 between the second end 52 of the snubber 48 and the second end 40 of the pathway, again regardless of the location of the snubber 48 at any given time.

The engine valve 12, pathway 36, snubber 48, and snubbing passage 54 all have circular cross-sections, but could be of any other shape. The pathway 36 is formed by drilling a longitudinal bore 28, in which the plunger 22 rides, and a lateral bore 60 of large enough size for the snubber 48 to reside, and then a smaller bore 62 extending therefrom and intersecting the longitudinal bore 28, the opening of the larger bore 60 having an insert 64 press-fitted therein to form the snubber cavity 42. Although not shown, the second end 40 of the pathway 36 is in selective communication with a high pressure fluid supply, about 21,000 psi, and a low pressure fluid supply, about 1,000 psi. A preferred means for selectively communicating the pathway 36 between the high and low pressure fluid supplies is by use of an axially displaceable spool valve which, depending upon its axial displacement, communicates either the high pressure fluid or the low pressure fluid to the pathway 36.

In the preferred embodiment, high pressure fluid is used to open the poppet valve 12 and the same fluid is snubbed to slow the valve 12 during closing. Alternatively, some other fluid such as gas or air could be used. Therefore, as used herein, the term "fluid" is intended to include gases or liquids. Also, alternatively, the poppet valve 12 could be opened mechanically or by some other means but closed against the resistive force of a snubbed fluid.

Also, in an alternative embodiment, instead of having close diametric clearance between the outside of the snubber 48 and the walls 66 of the snubber cavity 42, the diameter of the snubber 48 could be sized appreciably smaller than the internal diameter of the snubber cavity 42, in which case the snubbing passage 54 could be on the outside of the snubber 48 between the snubber 48 and the cavity walls 66, or in another embodiment, there might still be close diametric clearance but the snubbing passage 54 may be a slot formed on the outside of the snubber.

Industrial Applicability

The description of the functioning of the apparatus 10 of the present invention begins with the snubber 48 at its second location, the engine poppet valve 12 at its second location, low pressure hydraulic fluid in the pathway 36, and the spool valve positioned so that the fluid pathway 36 is in communication with the low pressure fluid supply.

Sensors within the engine sense engine operating conditions and signals are relayed to a control system containing logic maps and a governing algorithm. The control system processes the information and at the appropriate time closes an electrical circuit sending current to an electrically energized actuator whose movement displaces the spool valve, opening communication of the high pressure fluid with the fluid pathway 36. The high pressure travels as a pressure wave through the fluid already in the pathway 36. The high pressure wave hits the second end 52 of the snubber 48 and displaces the snubber 48 from its second location in the direction of its first location. The high pressure wave also travels through the snubbing passage 54 into the first section 56 of the pathway 36. As soon as the first section 56 of the pathway 36 is full of high pressure, the engine valve 12 begins to move from its second location towards its first location against the preload of the return spring 32. The valve 12 will continue to open until the bias force of the return spring 32 and the force of the high pressure fluid are in equilibrium or until the poppet valve 12 hits a hard stop. As the poppet valve 12 continues moving in the direction towards its first location, the snubber 48 continues moving in the direction towards its first location. The snubber 48 will continue its displacement until it hits the first end/hard stop 44 of the snubber cavity 42. Because of the practically instantaneous transmission of the pressure wave through the fluid in the pathway 36, the displacement of the snubber 48 over time will closely approximate the displacement over time of the poppet valve 12, although because of the compressibility of the hydraulic fluid between the first end 50 of the snubber 48 and the first end 20 of the engine valve 12, the snubber 48 may have a slightly greater displacement than the engine valve 12 over the same period of time. Once the snubber 48 hits the first end/hard stop 44 of the snubber cavity 42, the engine valve 12 will continue to open until the bias force of the return spring 32 and the force of the high pressure fluid are in equilibrium.

Displacement of the engine valve 12 during a first portion of displacement in the direction from the second location to the first location, which is that portion of displacement corresponding to the snubber's 48 displacement from its second location to its first location, is faster than the displacement of the engine valve 12 during a second portion of displacement in the same direction, which is that portion of its displacement after the snubber 48 has contacted the first end/hard stop 44 of the snubber cavity 42. This is so because during the first portion of displacement the first section 56 of the pathway 36 is in a hydraulic lock, meaning that the volume of the first section 56 does not increase, but during the second portion of displacement, the volume of the first section 56 increases and it takes time for the high pressure fluid to flow through the snubbing passage 54 and fill the increasing volume of the first section 56.

When the control system determines that it is time for the engine valve 12 to close, the spool valve is displaced to close-off communication of the pathway 36 with the high pressure fluid supply and to open communication of the pathway 36 with the low pressure fluid supply. The low pressure fluid supply acts somewhat like a sump in that it is able to absorb the high pressure of the high pressure fluid allowing the pressure to quickly, almost instantaneously, dissipate. However, unlike a simple drain sump, providing the low pressure fluid has the further advantage of preventing cavitation in the pathway 36 which could otherwise lead to unpredictable response and displacement events.

Next, as the high pressure dissipates, the bias force of the-return spring 32 begins to move the engine valve 12 from the first location in the direction of the second location. Again, the first section of the pathway 36 is in hydraulic lock and as the first end 20 of the poppet valve 12 is displaced, the force of the return spring 32 is transmitted through the engine valve 12 into the hydraulic fluid and against the first end 50 of the snubber 48, displacing it from its first location in the direction of its second location until the second end 52 of the snubber 48 is against the second end/hard stop 46 of the snubber cavity 42. This is the first portion of displacement of the engine poppet valve 12 in the direction from its first location to its second location. During this first portion of displacement, the displacement of the first end 20 of the engine valve 12 and the snubber 48 are roughly equivalent, for the same reasons set forth previously.

Preferably, the volume of the first section 56 of the pathway 36 when the snubber 48 and engine valve 12 are at their first locations is sized such that the engine valve 12 will be approximately 2 millimeters from its seat 24 when the snubber 48 contacts the second hard stop 46 of the snubber cavity 42 and the snubbing action begins. Over the last 2 millimeters of displacement of the engine poppet valve 12, which is the second portion of displacement of the engine poppet valve 12 in the direction from its first location to its second location, the fluid in the first section 56 flows through the snubbing passage 54. Because the cross-section of the first end 20 of the plunger 22 is greater than the smallest cross-section of the snubbing passage 54, the fluid in the first section 56 is compressed between the first end 50 of the snubber 48 and the first end 20 of the poppet valve 12. As the fluid is compressed, it provides a resistive force against the movement of the poppet valve 12 which slows the poppet valve's 12 seating velocity over the second portion of displacement of the poppet valve 12.

Once the poppet valve 12 has seated, the cycle is ready to be repeated.

Other aspects, objects and advantages of this invention can be obtained from a study of the drawings, the disclosure, and the appended claims.

We claim

1. A hydraulically actuated engine valve poppet assembly operable by selective application and dissipation of fluid pressure, the assembly comprising:

an engine valve body including a first fluid passageway adapted for communicating a fluid pressure from a fluid source;

an engine valve poppet connected to a plunger movably disposed in said first fluid passageway for movement between first and second positions in response to fluid pressure in said first passageway; and a dampening member movably disposed within said first fluid passageway and against a first stop in response to a low pressure fluid condition in said first passageway, said dampening member including a second fluid passageway for restricting fluid flow therethrough;

said dampening member being movable away from said first stop to communicate and force said fluid pressure against said plunger for actuating said engine valve poppet towards said second position and said dampening member being movable against said first stop during said low pressure condition to dampen movement of said engine valve poppet towards said first position as said fluid pressure is being dissipated primarily through said second fluid passageway.

2. The hydraulically actuated engine valve poppet assembly of claim 1, and further comprising a second stop, said dampening member being operable in a cavity defined between said first and second stops.

3. The hydraulically actuated engine valve poppet assembly of claim 2, wherein said first fluid passageway defines one of said first and second stops.

4. The hydraulically actuated engine valve poppet assembly of claim 2, wherein said first fluid passageway includes an insert defining one of said first and second stops.

5. The hydraulically actuated engine valve poppet assembly of claim 2, wherein said cavity is cylindrical in shape and said dampening member is a cylindrical member in close diametric clearance with said cavity.

6. The hydraulically actuated engine valve poppet assembly of claim 1, wherein said second fluid passageway is a cylindrical bore extending longitudinally through said dampening member.

7. The hydraulically actuated engine valve poppet assembly of claim 1, wherein said second fluid passageway is a slot extending longitudinally along said dampening member.

8. The hydraulically actuated engine valve poppet assembly of claim 1, wherein said second fluid passageway is an annular passageway defined between said dampening member and said first fluid passageway.

9. A hydraulically actuated engine valve poppet assembly, comprising:

a first source of fluid at low pressure;

a second source of fluid at high pressure;

an engine valve body including a first fluid passageway in selective fluid communication with said first and second sources;

an engine valve poppet connected to a plunger movably disposed in said first fluid passageway for movement between first and second positions in response to receiving low fluid pressure from said first source and high fluid pressure from said second source, respectfully; and a dampening member movably disposed within said first fluid passageway and against a first stop in response to receiving low fluid pressure from said first source, said dampening member including a second fluid passageway for restricting fluid flow therethrough to said first source;

said dampening member being movable away from said first stop to communicate and force high fluid pressure from said second source against said plunger for actuating said valve poppet towards said second position and said dampening member being movable against said first stop in response to receiving low fluid pressure from said second source to dampen movement of said engine valve poppet towards said first position as high fluid pressure is being dissipated primarily through said second fluid passageway to said first source.

10. The hydraulically actuated engine valve poppet assembly of claim 9, and further comprising a second stop, said dampening member being operable in a cavity defined between said first and second stops.

11. The hydraulically actuated engine valve poppet assembly of claim 10, wherein said first fluid passageway defines one of said first and second stops.

12. The hydraulically actuated engine valve poppet assembly of claim 10, wherein said first fluid passageway includes an insert defining one of said first and second stops.

13. The hydraulically actuated engine valve poppet assembly of claim 10, wherein said cavity is cylindrical in shape and said dampening member is a cylindrical member in close diametric clearance with said cavity.

14. The hydraulically actuated engine valve poppet assembly of claim 9, wherein said second fluid passageway is a cylindrical bore extending longitudinally through said dampening member.

15. The hydraulically actuated engine valve poppet assembly of claim 9, wherein said second fluid passageway is a slot extending longitudinally along said dampening member.

16. The hydraulically actuated engine valve poppet assembly of claim 9, wherein said second fluid passageway is an annular passageway defined between said dampening member and said first fluid passageway.

17. A method for slowing movement of an engine valve poppet during a portion of its travel, the engine valve poppet being in fluid communication with a hydraulic passageway and being actuable between first and second positions in response to fluid pressure in said hydraulic passageway, the hydraulic passageway including a dampening member actuable against a first stop in response to fluid pressure in said hydraulic passageway, said dampening member including a second fluid passageway for restricting fluid flow therethrough, the method comprising the steps of:

applying high fluid pressure in said hydraulic passageway to actuate said dampening member away from said first stop;

said dampening member moving with said high fluid pressure to actuate said engine valve poppet during a first portion of its travel from said first position to said second position;

applying low fluid pressure in said hydraulic passageway to actuate said dampening member against said first stop;

said dampening member being seated against said first stop to restrict fluid flow through said second fluid passageway to dampen movement of said engine valve poppet during a first portion of its travel from said second position to said first position as said high fluid pressure is being dissipated primarily through said second fluid passageway.

18. The method of claim 17, wherein said dampening member is further actuable against a second stop in response to fluid pressure in said hydraulic passageway and wherein:

in the step of applying high fluid pressure in said hydraulic passageway, said dampening member moves against said second stop to restrict fluid flow through said second fluid passageway to dampen movement of said engine valve poppet during a second portion of its travel from said first position to said second position as said high fluid pressure is being supplied primarily through said second fluid passageway; and in the step of applying low fluid pressure in said hydraulic passageway, said dampening member moves with said low fluid pressure to actuate said engine valve poppet during a second portion of its travel from said second position to said first position.

* * * * *